US007424243B2

(12) United States Patent
Kweon

(10) Patent No.: US 7,424,243 B2
(45) Date of Patent: Sep. 9, 2008

(54) STRUCTURE FOR INSTALLING DEVELOPING UNIT AND ELECTROPHOTOGRAPHIC IMAGE FORMING APPARATUS WITH THE SAME

(75) Inventor: Dae-seob Kweon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 322 days.

(21) Appl. No.: 11/413,208

(22) Filed: Apr. 28, 2006

(65) Prior Publication Data

US 2006/0257165 A1 Nov. 16, 2006

(30) Foreign Application Priority Data

May 10, 2005 (KR) ..... 10-2005-0039000

(51) Int. Cl.
*G03G 21/18* (2006.01)
*G03G 21/16* (2006.01)

(52) U.S. Cl. ..... 399/107; 399/110; 399/111

(58) Field of Classification Search ..... 399/107, 399/110, 111, 119
See application file for complete search history.

(56) References Cited

U.S. PATENT DOCUMENTS

| | | | | |
|---|---|---|---|---|
| 5,768,659 | A | 6/1998 | Kameda | |
| 6,064,843 | A | 5/2000 | Isobe et al. | |
| 7,292,803 | B2 * | 11/2007 | Ahn et al. | 399/110 |
| 7,330,679 | B2 * | 2/2008 | Kweon | 399/111 |
| 7,359,656 | B2 * | 4/2008 | Song | 399/110 |

FOREIGN PATENT DOCUMENTS

| | | |
|---|---|---|
| JP | 03-252667 | 11/1991 |
| JP | 05-066621 | 3/1993 |

* cited by examiner

*Primary Examiner*—Susan S Lee
(74) *Attorney, Agent, or Firm*—Stein, McEwen & Bui, LLP

(57) ABSTRACT

In a structure for removably installing a developing unit inside a case of an electrophotographic image forming apparatus and in an electrophotographic image forming apparatus employing the same, a guide rail is formed at an inner side of the case of the electrophotographic image forming apparatus and it slopes upward and inward. A guide protrusion is formed on an enclosing housing of the developing unit to slide along the guide rail to guide an installation of the developing unit into the case, and a handle is extended from the housing in a direction opposite to the guide rail with an upward slope.

20 Claims, 6 Drawing Sheets

STRUCTURE FOR INSTALLING DEVELOPING UNIT AND ELECTROPHOTOGRAPHIC IMAGE FORMING APPARATUS WITH THE SAME

CROSS-REFERENCE TO RELATED APPLICATIONS

This application claims the benefit of Korean Patent Application No. 2005-39000, filed May 10, 2005, in the Korean Intellectual Property Office, the disclosure of which is incorporated herein by reference.

BACKGROUND OF THE INVENTION

1. Field of the Invention

Aspects of the present invention relate to an electrophotographic image forming apparatus, and more particularly, to a structure for installing a developing unit in a case of an electrophotographic image forming apparatus.

2. Description of the Related Art

Typically, an electrophotographic image forming apparatus, such as a laser printer, a facsimile machine or a digital copier, scans a light beam across a uniformly charged photoconductor to form an electrostatic latent image on the photoconductor, applies toner (developing agent) to the electrostatic latent image to develop it into a visible toner image, transfers the visible toner image to a print medium, and fuses the toner image on the print medium to print a predetermined image.

FIG. 1 is a side sectional view of an electrophotographic image forming apparatus according to the related art.

Referring to FIG. 1, an electrophotographic image forming apparatus 10 defines a C-shaped print medium path for printing images on print media. The electrophotographic image forming apparatus 10 includes a developing unit 20 having a toner container and a photoconductor 25, a light scanning unit (LSU) 30 to scan a light beam corresponding to image data onto the photoconductor 25, and a transfer roller 27 to transfer a toner image formed on the photoconductor 25 to a print medium.

The developing unit 20 is detachably installed in a case 11 of the electrophotographic image forming apparatus 10. To install the developing unit 20 into the case 11, a user opens a door 12 formed at a side of the case 11 and inserts the developing unit 20 into the case 11 while holding a handle 21 of the developing unit 20. A guide rail 15 is formed in the case 11 to guide the developing unit 20 toward an installed position, which is indicated in FIG. 1 by a chain double-dashed outline. In the installed position, the photoconductor 25 of the developing unit 20 faces the transfer roller 27. Also, the developing unit 20 is formed with a first guide protrusion 22 and a second guide protrusion 23 that slide on the guide rail 15 when the developing unit 20 is guided by the guide rail 15.

However, when the guide rail 15 is a type that bends upward as it nears the installed position, it is difficult for a user to insert the developing unit 20 into the side of the case 11 and move it to the installed position in a single motion by using the handle 21. That is, when the guide protrusion 22 reaches the bent portion of the guide rail 15, the user has to re-grasp the handle 21 to further insert the developing unit 20 into the case 11. Further, since the handle 21 is placed deep in the case 11 when the developing unit 20 is in the installed position, it is difficult to remove the developing unit 20 from the case 11 by pulling out the handle 21.

SUMMARY OF THE INVENTION

Aspects of the present invention provide a structure for easily installing and uninstalling a developing unit and electrophotographic image forming apparatus with the same.

Aspects of the present invention also provide an electrophotographic image forming apparatus that includes an upwardly sloped guide rail and a developing unit, the developing unit being easily installed and uninstalled to and from an install position by the guide rail.

Additional aspects and/or advantages of the invention will be set forth in part in the description which follows and, in part, will be obvious from the description, or may be learned by practice of the invention.

According to an aspect of the present invention, there is provided a structure for installing a developing unit into an installed position inside an electrophotographic image forming apparatus, the structure including: a guide rail formed at an inner side of a case of the electrophotographic image forming apparatus, the guide rail sloping upward toward the installed position; a guide protrusion formed on an enclosing housing of the developing unit to slide along the guide rail to guide an installation of the developing unit into the case; and a handle that extends from the housing in a direction opposite to the guide rail, the handle having an upward slope.

The guide rail may include a horizontally extended introductory portion and an upwardly sloped portion extended from an end of the introductory portion, and the handle may include a first extension extended from the housing and a second extension extended from an end of the first extension with an upward slope.

The introductory portion and the sloped portion of the guide rail may form an angle of 120 to 180 degrees, and the first extension and the second extension of the handle may form an angle of 120 to 180 degrees.

The handle may be foldably hinged to the housing.

The housing may include a stopper to prevent the handle from further rotating after the handle is unfolded at a predetermined angle to the housing.

The guide protrusion may be coaxial with a photoconductor that is provided in the developing unit to form an electrostatic latent image thereon when exposed to a light beam.

The structure may further include an auxiliary protrusion formed on the housing, the auxiliary protrusion acting as a pivoting point when the developing unit is installed and uninstalled.

The auxiliary protrusion may be a first auxiliary protrusion, and the structure may further include: a second auxiliary protrusion formed on the housing; and a pressing unit to elastically depress the second auxiliary protrusion when the developing unit is installed in the case.

According to another aspect of the present invention, there is provided an electrophotographic image forming apparatus including: a case; a developing unit including an enclosing housing; and a structure to removably install the developing unit into an installed position in the case, the structure including a guide rail formed at an inner side of the case and that slopes upwardly toward the installed position, a guide protrusion formed on the housing of the developing unit to slide along the guide rail to guide the installation of the developing unit into the case, and a handle that extends from the housing in a direction opposite to the guide rail, the handle having an upward slope.

The guide rail may include a horizontally extended introductory portion and an upwardly sloped portion extended from an end of the introductory portion, and the handle may include a first extension extended from the housing and a second extension extended from an end of the first extension with an upward slope.

The introductory portion and the sloped portion of the guide rail may form an angle of 120 to 180 degrees, and the first extension and the second extension of the handle may form an angle of 120 to 180 degrees.

The handle may be foldably hinged to the housing.

The housing may include a stopper to prevent the handle from further rotating after the handle is unfolded at a predetermined angle to the housing.

The developing unit may further include a photoconductor to form an electrostatic latent image thereon when exposed to a light beam, and the guide protrusion is coaxial with the photoconductor.

The electrophotographic image forming apparatus may further include an auxiliary protrusion formed on the housing, the auxiliary protrusion acting as a pivoting point when the developing unit is installed and uninstalled.

The auxiliary protrusion is a first auxiliary protrusion, the electrophotographic image forming apparatus may further include: a second auxiliary protrusion formed on the housing; and a pressing unit to elastically depress the second auxiliary protrusion when the developing unit is installed in the case.

According to another aspect of the present invention, a developing unit of an electrophotographic image forming apparatus comprises: a housing; a photoconductive roller supported by the housing; a guide protrusion extending from the housing coaxial to the photoconductive roller; and a handle foldably hinged to the housing at a side of the housing opposite the photoconductive roller, wherein the handle includes a first extension attached to the housing and a second extension that extends from an end of the first extension and wherein the first extension and the second extension form an angle of 120 to 180 degrees and wherein the housing includes a stopper that prevents the handle from rotating beyond a predetermined angle to the housing.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
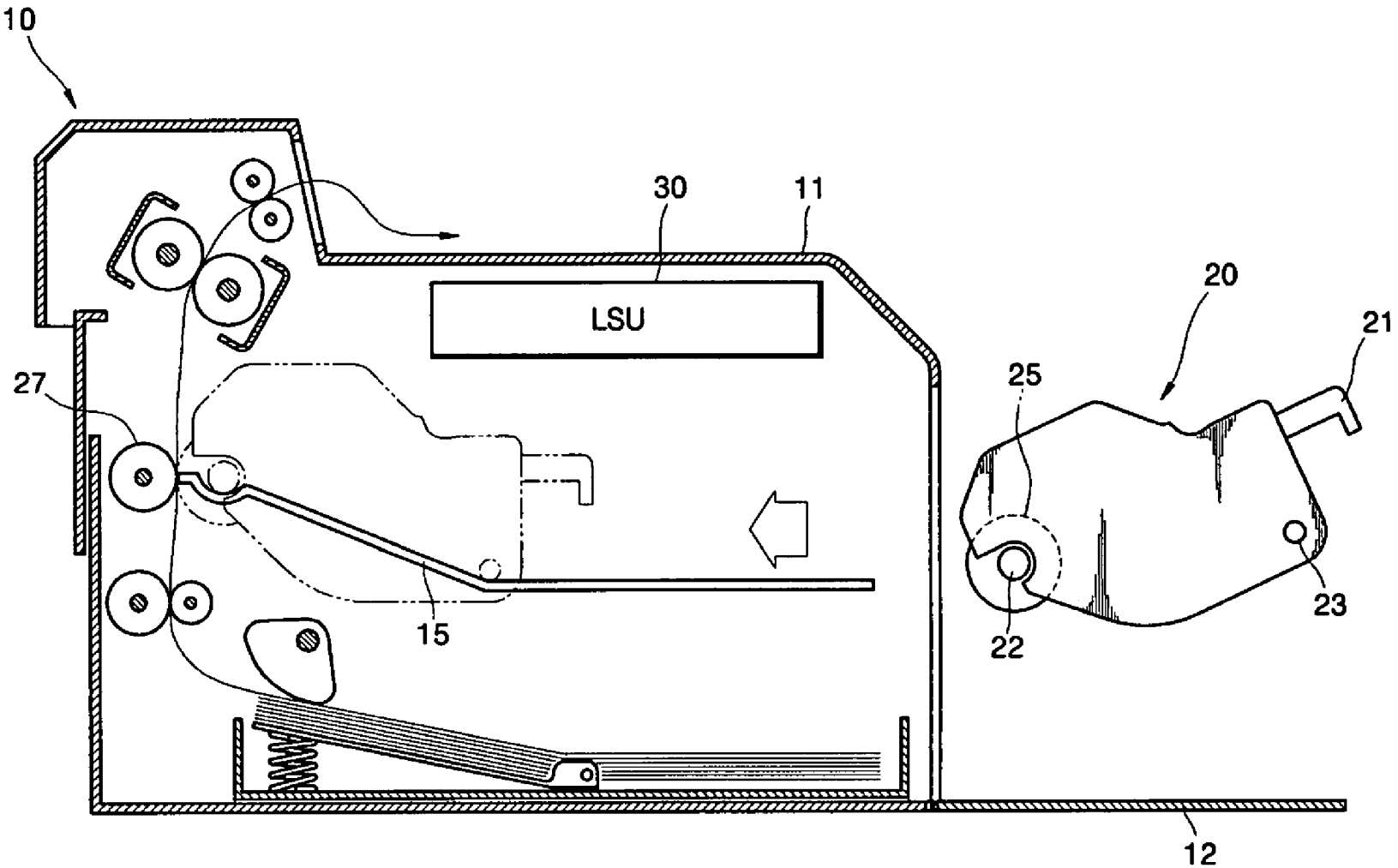
FIG. 1 (PRIOR ART)
FIG. 1 is a side sectional view of an electrophotographic image forming apparatus according to the related art.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
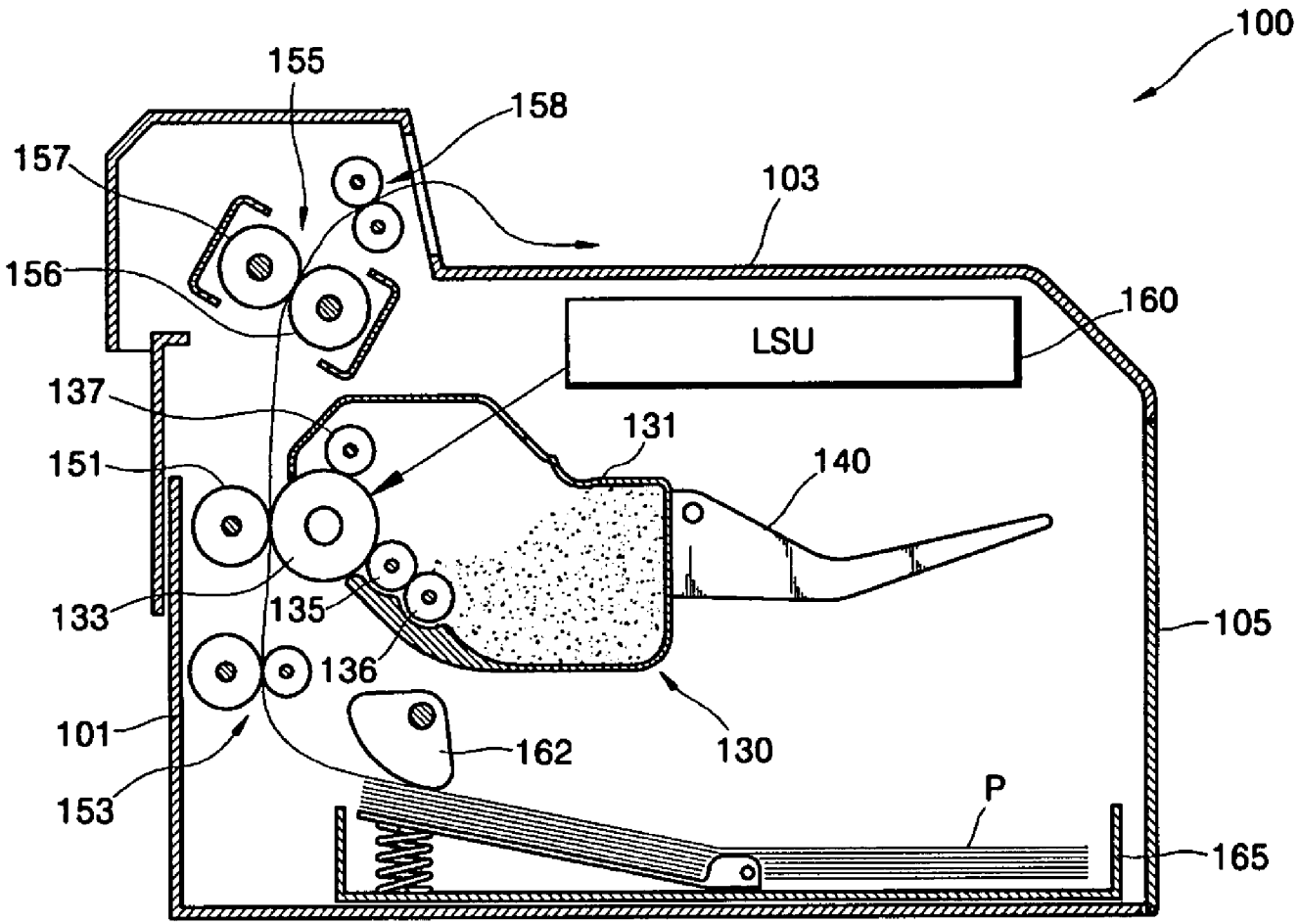
FIG. 2 is a side sectional view of an electrophotographic image forming apparatus according to an embodiment of the present invention.

FIG. 2 is a side sectional view of an electrophotographic image forming apparatus according to an embodiment of the present invention.

Referring to FIG. 2, an electrophotographic image forming apparatus 100 defines a C-shaped print medium path along which print media P are transported for printing images thereon. Typically, the print medium is paper, particularly sheets of paper. However, it is to be understood other print media can be used. In particular, any other print medium, such as, for example, plastic or textile, that is in a form that can be transferred by a transfer unit and that can be fixed with a printed image can be used according to an aspect of the present invention. The electrophotographic image forming apparatus 100 includes a case 101 and a developing unit 130 that is detachably installed in the case 101. Also, the electrophotographic image forming apparatus 100 includes a fuser 155, a transfer roller 151, and a light scanning unit (LSU) 160.

The developing unit 130 includes an enclosing housing 131, a photoconductor 133, a charge roller 137, and a developer roller 135, and a toner-supply roller 136. The housing 131 contains toner (developing agent), the photoconductor 133 forms an electrostatic latent image thereon when exposed to a light beam, the charge roller 137 charges the developer roller 135 with a predetermined potential, the developer roller 135 applies toner to the electrostatic latent image of the photoconductor 133 to develop it into a visible toner image, and the toner-supply roller 136 supplies toner to the developer roller 135. Though not shown, the developing unit further includes a waste toner cleaner to remove waste toner from the photoconductor 133, a doctor blade to regulate the thickness of the toner on the developer roller 135, and an agitator to stir the toner contained in the housing 131 to prevent the toner from hardening. The developing unit 130 is constructed in the form of a cartridge such that it can be easily replaced with new one.

The transfer roller 151 faces and contacts the photoconductor 133 to press the print medium P against the photoconductor 133 when the print medium P passes therethrough, such that a toner image formed on the photoconductor 133 can be transferred to the print medium P.

The fuser 155 includes a heat roller 156 and a pressure roller 157 engaged with the heat roller 156 to apply heat and pressure to the toner image of the print medium P to securely attach the toner image on the print medium P.

The electrophotographic image forming apparatus 100 further includes a cassette 165 to store print media P, a pick-up roller 162 to pick up the print media P one by one from the cassette 165, feed rollers 153 to feed the picked-up print media P toward the developing unit 130 while aligning the print media P for an exact printing, and eject rollers 158 to discharge the print media P from the case 101 to an output tray 103 after printing.

The operation of the electrophotographic image forming apparatus 100 will now be described. The charge roller 137 charges the photoconductor 133 with a predetermined potential, and the LSU 160 scans a light beam corresponding to an image to be printed across the photoconductor 133 to form an electrostatic latent image on the photoconductor 133. The toner-supply roller 136 supplies toner from the housing 131 to the developer roller 135, and then the developer roller 135 applies the toner to the photoconductor 133 to develop the electrostatic latent image into a visible toner image. Meanwhile, the pick-up roller 162 picks up the print media P one by one from the cassette 165, and the feed rollers 153 exactly feed the picked-up print media P toward between the photoconductor 133 and the transfer roller 151. While the print medium P passes between the photoconductor 133 and the transfer roller 151, the visible toner image is transferred from the photoconductor 133 to the print medium P. Then, the fuser 155 applies heat and pressure to the toner image to securely attach the toner image on the print medium P, and the discharge rollers 158 discharges the print medium P to the output tray 103.

Figure 3:
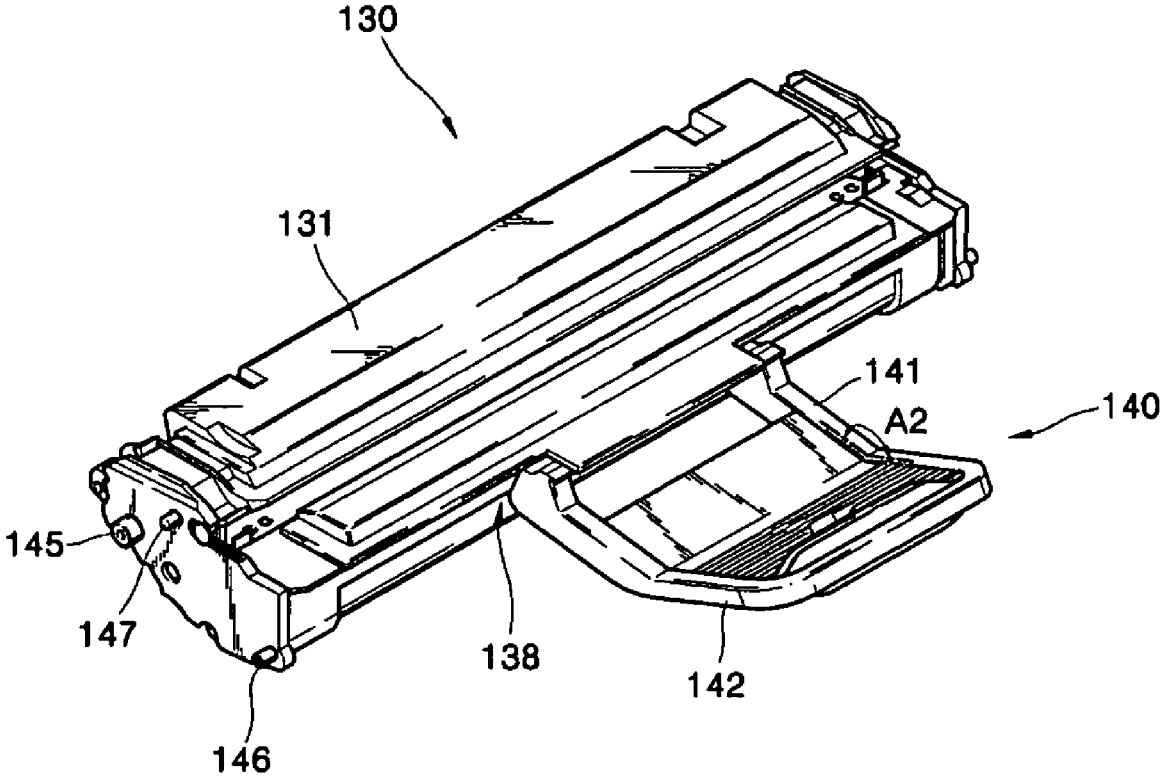
FIGS. 3 and 4 are perspective views of a developing unit of the electrophotographic image forming apparatus depicted in FIG. 2, in which unfolded and folded positions of a handle of the developing unit are respectively shown.
Figure 4:
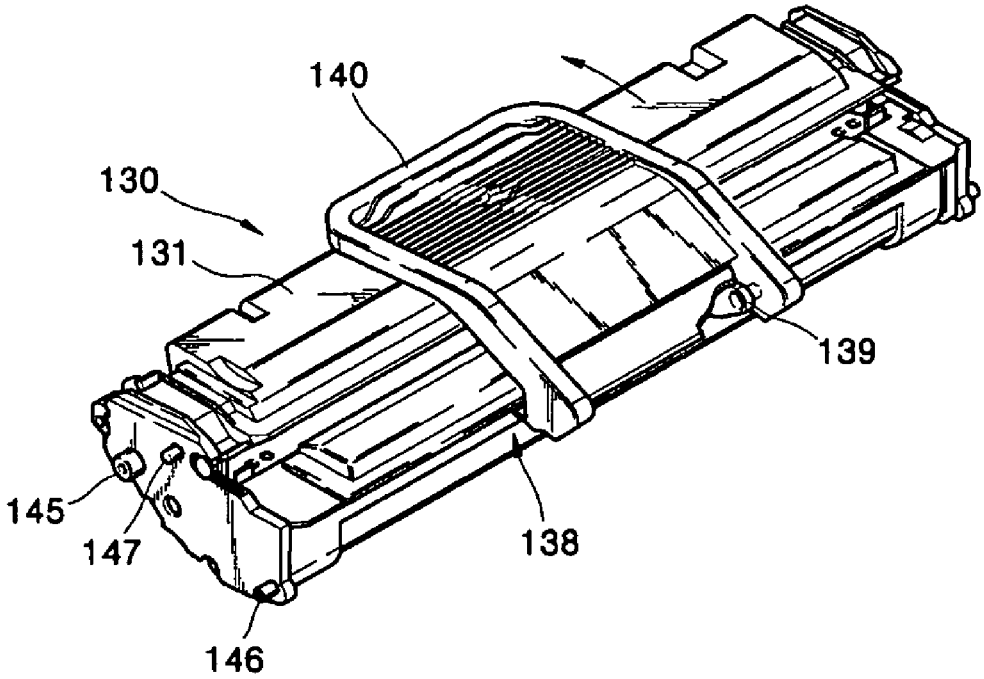
Figure 5:
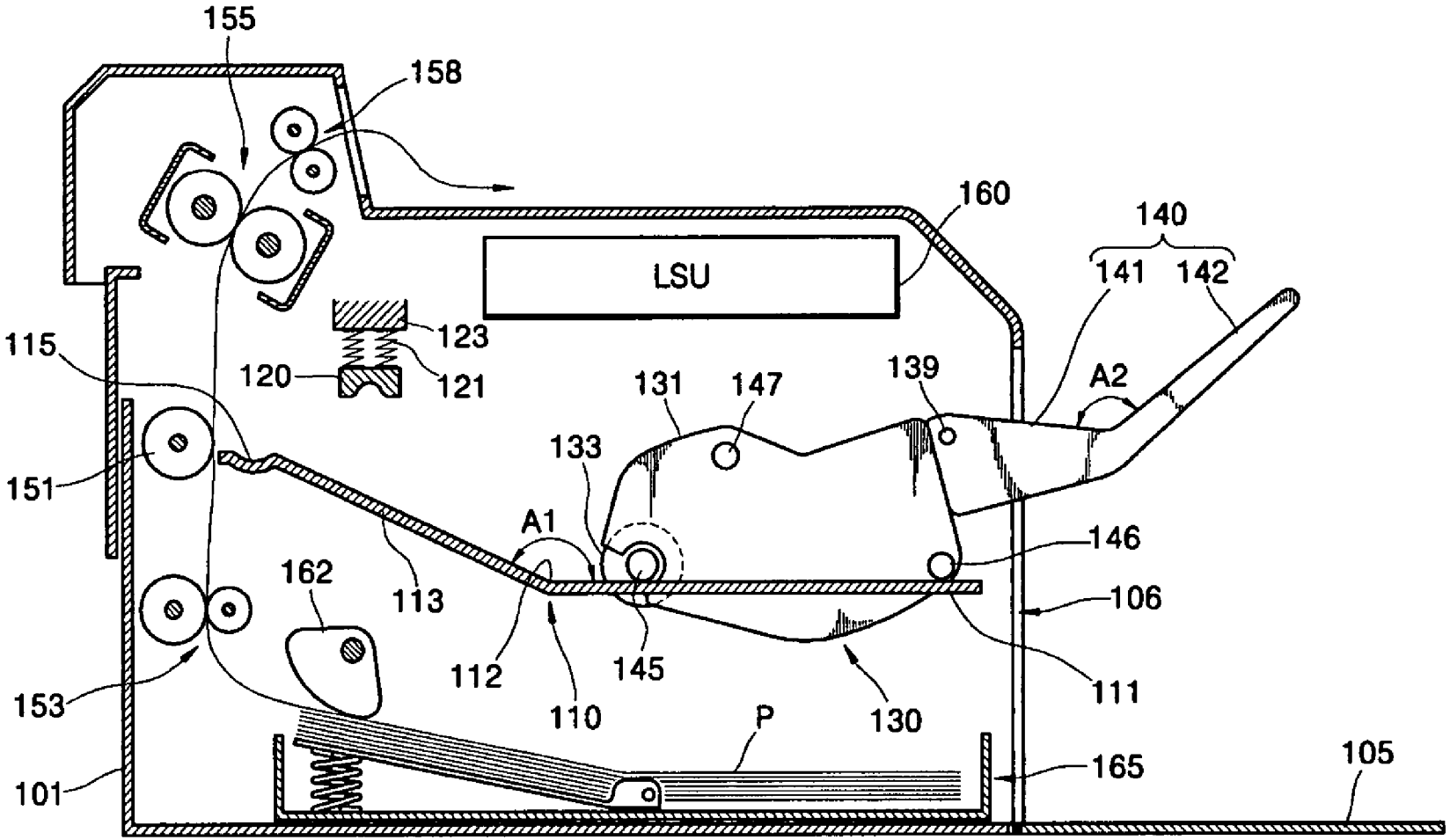
FIGS. 5 to 7 are sectional views sequentially showing an installation of the developing unit of FIGS. 3 and 4 into the electrophotographic image forming apparatus of FIG. 2.
Figure 6:
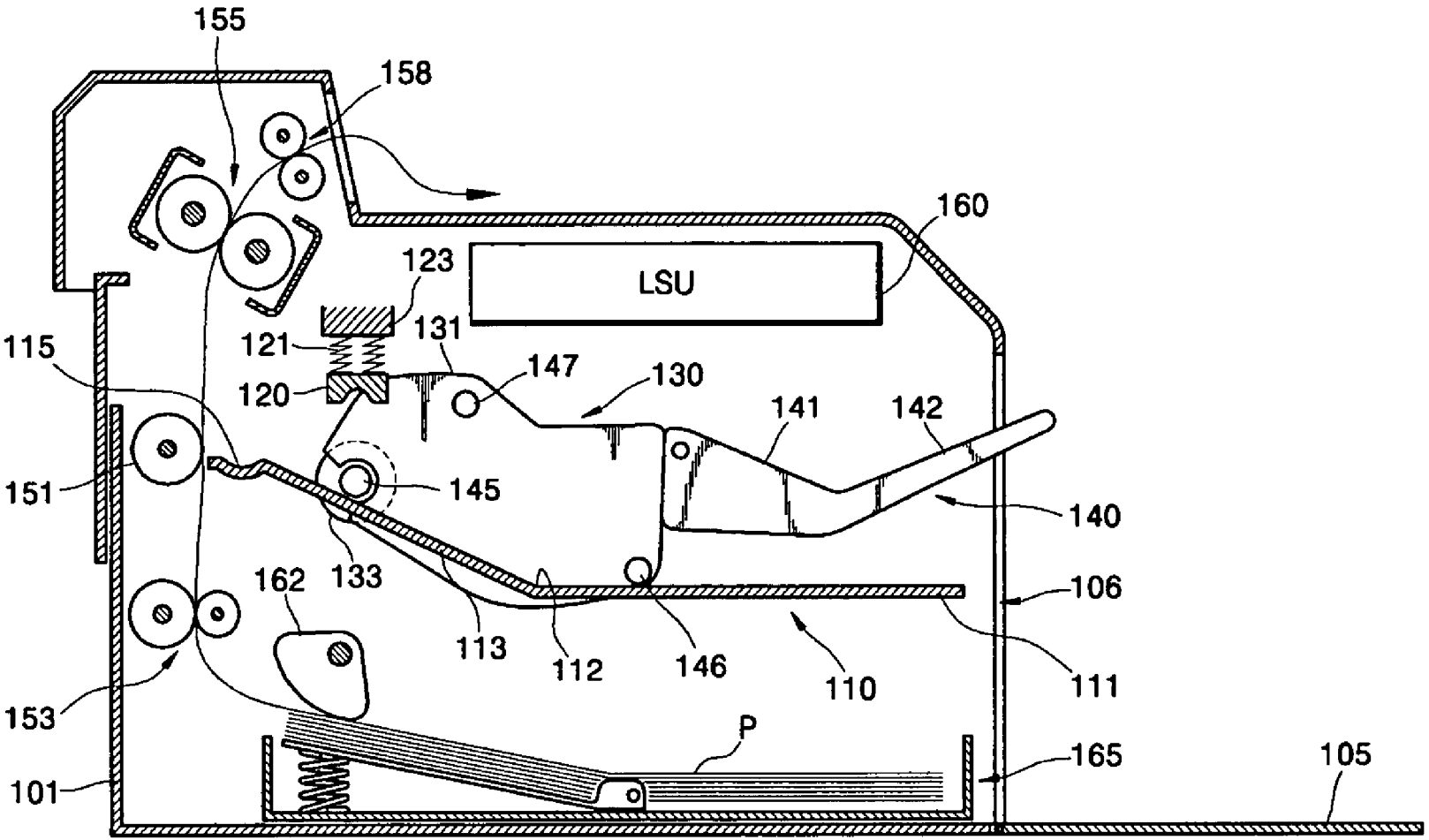
Figure 7:
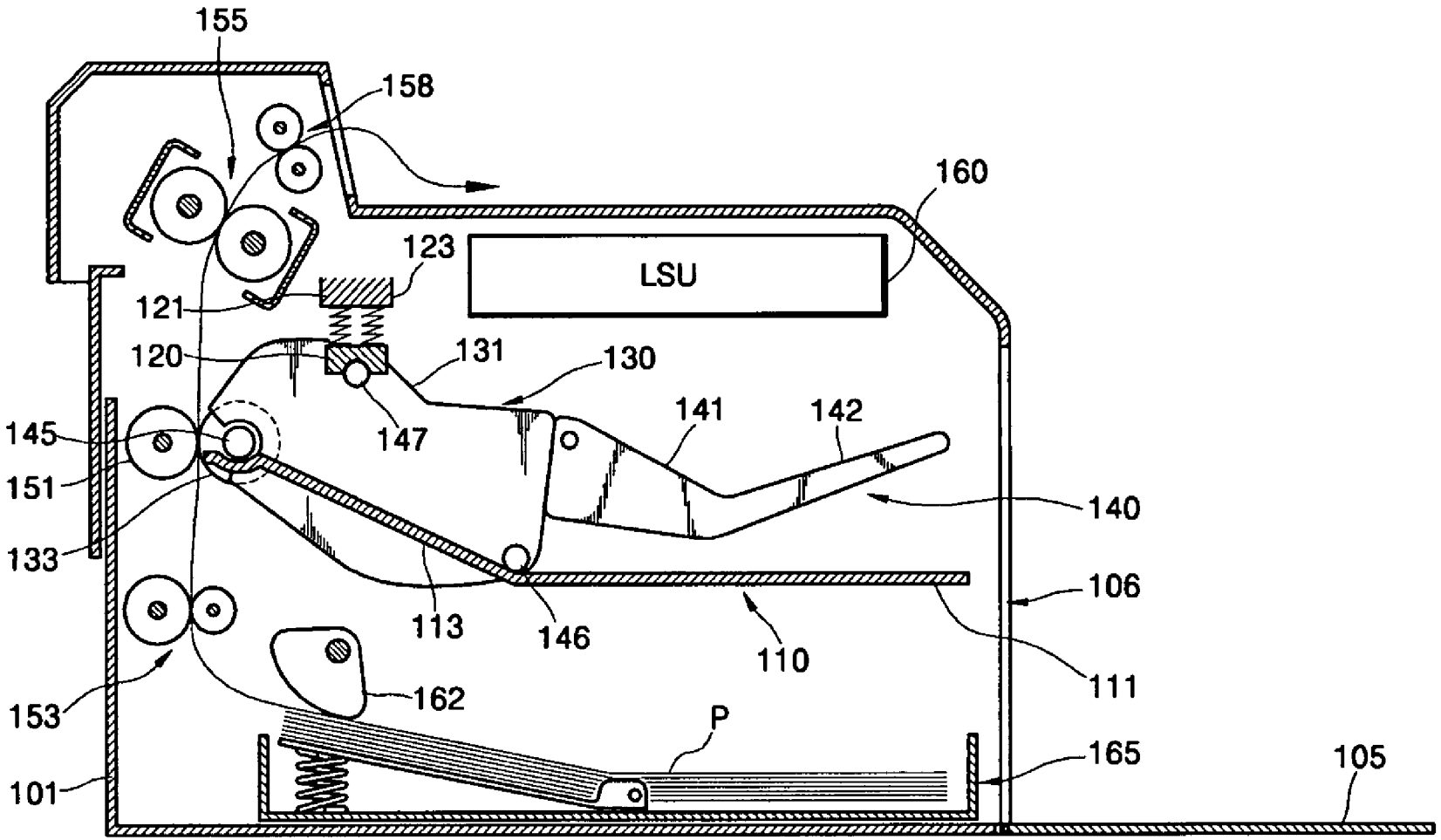

FIGS. 3 and 4 are perspective views of the developing unit 130 of the electrophotographic image forming apparatus depicted in FIG. 2, in which unfolded and folded positions of a handle 140 of the developing unit are respectively shown, and FIGS. 5 to 7 are sectional views sequentially showing the installation of the developing unit 130 into an electrophotographic image forming apparatus according to an aspect of the present invention.

Referring to FIGS. 5 to 7, the developing unit 130 is inserted through an opening 106 created by opening a door 105 formed at a side of the case 101. A guide rail 110 is provided in the case 101 to guide the developing unit 130 from the opening 106 to an installed position.

The guide rail 110 is formed at a frame (not shown) inside of the case 101. The guide rail 110 includes an introductory portion 111 that extends horizontally from the periphery of the opening 106 and a sloped portion 113 that extends from an end of the introductory portion 111 in an upward direction. As used herein, the terms "horizontally," "upwardly" and other terms of direction are used as they would be commonly understood with respect to a conventional orientation in an image forming apparatus. Typically, an image forming apparatus has a top and bottom and sides. Within the image forming apparatus, then, the term "horizontally" means in a direction between the sides without moving towards the top or bottom, and the terms "upwardly" and "in an upward direction" mean in a direction that is not parallel to the top or bottom, but rather extends towards the top of the image forming apparatus. Further, as used herein, the term "inwardly" means in a direction towards an installed position and the term "outwardly" means in a direction towards removal from the case 101. When discussing the housing 131 of the developer unit 130, the "front" of the unit is the portion that faces the direction of motion along the guide rail when the developer unit 130 is being installed into the image forming apparatus and the "back" of the housing is the opposite portion, which faces the direction of motion along the guide rail when the developing unit is removed from the image forming apparatus.

Though the installation of the developing unit 130 is easier when the angle A1 between the sloped portion 111 and the introductory portion 113 of the guide rail is larger (that is, when the amount of upward slope in the sloped portion is less), a smaller angle A1 allows for the size of the electrophotographic image forming apparatus 100 to be reduced. The angle A1 is preferably from 120 to 180 degrees.

The developing unit 130 shown in FIGS. 3 and 4 includes a guide protrusion 145, a first auxiliary protrusion 146, and a second auxiliary protrusion 147 that are formed on a side of the housing 131. The guide protrusion 145 slides inwardly on the guide rail 110 to guide the developing unit 130 as the developing unit 130 is moved inwardly to an installed position in the case 101 when the developing unit 130 is being installed, and it slides outwardly on the guide rail 110 to guide the developing unit as the developing unit is moved outwardly from the installed position to the opening 106 when the developing unit is being uninstalled. When the developing unit 130 is fully inserted in the installed position, the guide protrusion 145 falls onto a mounting groove 115 defined at the end of the sloped portion 113, and the photoconductor 133 faces the transfer roller 151. The guide protrusion 145 is coaxial with the photoconductor 133 to prevent the photoconductor 133 from shaking when the photoconductor 133 is rotated to receive a light beam from the LSU 160. That is, the guide protrusion 145 is formed coaxially with the photoconductor 133 to prevent an image forming error.

The first auxiliary protrusion 146 is formed on the side of the housing 131 at a rear lower end to slide along the guide rail 110 to guide the developing unit 130. The developing unit 130 can be placed on the guide rail 110 such that a user can easily slide the developing unit 130 on the guide rail 110 in forward and backward directions without deviation, owing to stability provided by the guide protrusion 145 and the first auxiliary protrusion 146. When the developing unit 130 is fully inserted in the installed position as shown in FIG. 7, the first auxiliary protrusion 146 comes to rest at a connecting portion 112 between the introductory portion 111 and the sloped portion 113 of the guide rail 110.

While the guide protrusion 145 slides up the sloped portion 113, the developing unit 130 is rotated about the first auxiliary protrusion 146 in a clockwise direction by the same angle as the angle A1 of the sloped portion 113. That is, the first auxiliary protrusion 146 acts as a pivoting point for the developing unit 130 when the guide protrusion 145 slides up the sloped portion 113. When the developing unit 130 is removed from the installed position, the first auxiliary protrusion 146 also acts as a pivoting point for the developing unit 130, which is rotated counterclockwise.

The second auxiliary protrusion 147 is formed on the side of the housing 131 at an upper end. As shown in FIG. 7, when the developing unit 130 is placed in the installed position, the second auxiliary protrusion 147 is elastically depressed by a pressing unit 120. That is, the guide protrusion 145 falls on the mounting groove 115, the first auxiliary protrusion 146 is supported by the connecting portion 112, and the second auxiliary protrusion is depressed downward, such that the developing unit 130 can be supported at three points when it is in the installed position. Therefore, the developing unit 130 can be securely held in the installed position even when impact is applied, and thereby, images can be successively printed at a high quality level.

The pressing unit 120 is supported by an inner frame 123 of the case 101, and springs 121 are disposed between the pressing unit 120 and the inner frame 123. Instead of the springs 121 shown in FIGS. 5 to 7, the pressing unit 120 may be made of elastic material or it may be constructed in the form of a tension plate.

Referring to FIGS. 3 and 4, the developing unit 130 includes a handle 140 that is hinged on a back of the housing 131. When the developing unit 130 is inserted into the case 101 with its front pointing inwards, the handle 140 extends from the back of the housing 131 in a direction opposite to the guide rail 110, that is, in a direction opposite to the direction that the developing unit 130 moves along the guide rail when it is being installed. The handle 140 may include a first extension 141 extended from the back of the housing 131 and a second extension 142 extended from an end of the first extension 141 in an upward direction at a predetermined angle.

The angle A2 between the first extension 141 and the second extension 142 of the handle 140 may be from 120 to 180 degrees and may be the same as the angle A1 (refer to FIG. 5) between the introductory portion 111 and the sloped portion 113 of the guide rail 110. The handle 140 is sized such that a free end of the second extension 142 is extended to the periphery of the opening 106 when the developing unit 130 is placed in the install position as shown in FIG. 7.

Since the handle 140 is connected to the housing 131 using a hinge unit 139, the handle 140 can be folded against the housing 131 and unfolded from the housing 131. When transporting and storing the developing unit 130 separately from the electrophotographic image forming apparatus 100, the developing unit 130 can be packed with a relatively small packing box after folding the handle 140 by rotating it toward the housing 131. That is, the developing unit 130 can be easily transported and stored with less cost because of its compact size when the handle 140 is folded. The housing 131 is formed with a stopper 138 to restrict the angle of the unfolded handle 140, such that the handle 140 can be prevented from being excessively unfolded.

Referring again to FIGS. 5 and 7, installing and uninstalling operations of the developing unit 130 to and from the case 101 will now be described in detail.

A user opens the door 105 of the case 101 and inserts the developing unit 130 into the case 101 through the opening 106 by holding the handle 140. As shown in FIG. 5, the inserted developing unit 130 is supported by the guide rail 110 at the guide protrusion 145 and the first auxiliary protrusion 146, and it proceeds toward the transfer roller 151 along the guide rail 110 when the handle 140 is pushed.

When the handle 140 is pushed further, the guide protrusion 145 rides on the sloped portion 113 of the guide rail 110 and this causes the developing unit 130 to rotate about the first auxiliary protrusion 146 in a clockwise direction and the handle 140 to rotate downwards. The user can easily make the developing unit 130 slide up the sloped portion 113 of the guide rail 110 by using the handle 140 as a lever. That is, the developing unit 130 can be easily slid up the sloped portion 113 when the user slightly depresses the handle 140 while pushing it. Therefore, the user does not need to alter the grasping of the handle 140 in order to slide the developing unit 130 up the sloped portion 113. Also, since the handle 140 rotates downwards as it moves into the case 101 through the opening 106, the second extension 142 of the handle 140 does not collide with the case 101 around the opening 106.

After sliding along the sloped portion 113, the developing unit 130 is placed in the installed position as shown in FIG. 7. In the installed position, the guide protrusion 145 falls on the mounting groove 115 of the guide rail 110, the first auxiliary protrusion 146 is placed on the connecting portion 112 between the introductory portion 111 and the sloped portion 113, and the second auxiliary portion 147 is depressed by the pressing unit 120. Therefore, the developing unit 130 can be securely held in the installed position by the three-point supporting structure.

The developing unit 130 can be readily removed from the installed position by pushing the end of the handle 140 downward. That is, when the second extension 142 of the handle 140 is slightly depressed, the developing unit 130 is rotated about the first auxiliary protrusion 146 and thus the guide protrusion 145 can be released from the mounting groove 115. After the guide protrusion 145 is released from the mounting groove 115, the guide protrusion freely slides down the sloped portion 113 of the guide rail 110 under the influence of gravity, allowing the developing unit 130 to move outwardly along the guide rail 110. The developing unit 130 can be taken out of the case 101 through the opening 106 by pulling on the handle 140. Since the handle 140 extends to the periphery of the opening 106, the user can easily grasp the handle 140 to pull the developing unit 130 out. That is, the user does not need to put his or her hand deeply into the case in order to reach the handle 140.

As described above, even though the guide rail of the electrophotographic image forming apparatus includes a portion that is upwardly sloped, the developing unit can be easily installed and removed to and from the installed position in the case along the sloped guide rail with less effort. Further, the developing unit can be installed at one time and in a single motion without the user having to re-grasp the handle of the developing unit during installation.

In addition, the handle can be folded against the housing of the developing unit according to an embodiment of the present invention, such that the developing unit can be easily transported and stored with less cost.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A structure for installing a developing unit into an installed position inside an electrophotographic image forming apparatus, the structure comprising:

a guide rail formed at an inner side of a case of the electrophotographic image forming apparatus, the guide rail sloping upwardly towards the installed position;

a guide protrusion formed on an enclosing housing of the developing unit to slide along the guide rail to guide the installing of the developing unit; and a handle that extends from the housing in a direction opposite to the guide rail, the handle having an upward slope.

2. The structure of claim 1, wherein the guide rail includes a horizontally extended introductory portion and an upwardly sloped portion extended from an end of the introductory portion, and the handle includes a first extension extended from the housing and a second extension extended from an end of the first extension with an upward slope.

3. The structure of claim 2, wherein the introductory portion and the sloped portion of the guide rail form an angle of 120 to 180 degrees, and wherein the first extension and the second extension of the handle form an angle of 120 to 180 degrees.

4. The structure of claim 1, wherein the handle is foldably hinged to the housing.

5. The structure of claim 4, wherein the housing includes a stopper to prevent the handle from further rotating after the handle has been unfolded to a predetermined angle to the housing.

6. The structure of claim 1, wherein the guide protrusion is coaxial with a photoconductor that is provided in the developing unit to form an electrostatic latent image thereon when exposed to a light beam.

7. The structure of claim 1, further comprising an auxiliary protrusion formed on the housing, the auxiliary protrusion acting as a pivoting point when the developing unit is installed and uninstalled.

8. The structure of claim 7, wherein the auxiliary protrusion is a first auxiliary protrusion, and wherein the structure further comprises:

a second auxiliary protrusion formed on the housing; and a pressing unit to elastically depress the second auxiliary protrusion when the developing unit is installed in the case.

9. The structure of claim 1, wherein the guide rail includes a mounting groove that engages the guide protrusion when the developing unit is in the installed position.

10. An electrophotographic image forming apparatus comprising:

a case;

a developing unit including an enclosing housing; and a structure to removably install the developing unit into an installed position inside the case, the structure including a guide rail formed at an inner side of the case and sloping upward towards the installed position, a guide protrusion formed on the housing of the developing unit to slide along the guide rail to guide the installation of the developing unit into the case, and a handle that extends from the housing in a direction opposite to the guide rail, the handle having an upward slope.

11. The electrophotographic image forming apparatus of claim 10, wherein the guide rail includes a horizontally extended introductory portion and an upwardly sloped portion extended from an end of the introductory portion, and the handle includes a first extension that extends from the housing and a second extension that extends from an end of the first extension and that has an upward slope.

12. The electrophotographic image forming apparatus of claim 11, wherein the introductory portion and the sloped portion of the guide rail form an angle of 120 to 180 degrees, and wherein the first extension and the second extension of the handle form an angle of 120 to 180 degrees.

13. The electrophotographic image forming apparatus of claim 10, wherein the handle is foldably hinged to the housing.

14. The electrophotographic image forming apparatus of claim 13, wherein the housing includes a stopper to prevent the handle from further rotating after the handle has been unfolded to a predetermined angle to the housing.

15. The electrophotographic image forming apparatus of claim 10, wherein the developing unit further includes a photoconductor to form an electrostatic latent image thereon when exposed to a light beam and the guide protrusion is coaxial with the photoconductor.

16. The electrophotographic image forming apparatus of claim 10, further comprising an auxiliary protrusion formed on the housing, the auxiliary protrusion acting as a pivoting point when the developing unit is installed and uninstalled.

17. The electrophotographic image forming apparatus of claim 16, wherein the auxiliary protrusion is a first auxiliary protrusion, and wherein the structure further comprises:

a second auxiliary protrusion formed on the housing; and a pressing unit to elastically depress the second auxiliary protrusion when the developing unit is installed in the case.

18. The electrophotographic image forming apparatus of claim 16, wherein the guide rail includes a mounting groove that engages the guide protrusion when the developing unit is in the installed position.

19. A developing unit of an electrophotographic image forming apparatus comprising:

a housing;

a photoconductive roller supported by the housing;

a guide protrusion extending from the housing coaxial to the photoconductive roller; and a handle foldably hinged to the housing at a side of the housing opposite the photoconductive roller, wherein the handle includes a first extension attached to the housing and a second extension that extends from an end of the first extension and wherein the first extension and the second extension form an angle of 120 to 180 degrees and wherein the housing includes a stopper that prevents the handle from rotating beyond a predetermined angle to the housing.

20. The developing unit of claim 19, wherein the handle can be rotated between a first position in which the handle rests against the housing to a second position in which the handle extends from the housing at the predetermined angle.

* * * * *